United States Patent [19]

Siemon

[11] Patent Number: 4,759,723

[45] Date of Patent: Jul. 26, 1988

[54] PATCH CONNECTOR

[75] Inventor: John A. Siemon, Watertown, Conn.

[73] Assignee: The Siemon Company, Watertown, Conn.

[21] Appl. No.: 879,593

[22] Filed: Jun. 27, 1986

[51] Int. Cl.[4] ..... H01R 4/24

[52] U.S. Cl. ..... 439/409; 439/459; 439/467; 439/596; 439/687

[58] Field of Search ..... 339/97 R, 97 P, 98, 339/99 R; 449/391, 395, 409, 410, 417, 456, 459, 465, 467, 596, 686, 687

[56] References Cited

U.S. PATENT DOCUMENTS

| | | | |
|---|---|---|---|
| 3,835,444 | 9/1974 | Plana et al. | 339/98 |
| 3,835,445 | 9/1974 | Hardesty | 339/99 R |
| 4,023,879 | 5/1977 | Braund et al. | 439/465 |
| 4,095,862 | 6/1978 | Hatch | 339/97 R X |
| 4,145,103 | 3/1979 | Knowles | 339/99 R |
| 4,163,598 | 8/1979 | Bianchi et al. | 439/467 |
| 4,191,444 | 3/1980 | Smith et al. | 439/467 |
| 4,585,290 | 4/1986 | Knickerbocker et al. | 439/395 |

FOREIGN PATENT DOCUMENTS

| | | | |
|---|---|---|---|
| 2854903 | 7/1979 | Fed. Rep. of Germany | 439/459 |

*Primary Examiner*—John McQuade

*Attorney, Agent, or Firm*—Fishman, Dionne & Cantor

[57] ABSTRACT

The unassembled patch connector comprises multiple or a single, housing (prefereably molded) having a centrally located hinge or other positive locating features for joining the two oppositely disposed housing portions. The housing portions are snapped together to define a substantially rectangular housing having two, four, six or eight openings on a front face thereof for accessing terminals from a terminal block; and at least one other opening on the back face thereof for entry and exit of a cable or individual wires. The interior of the housing is provided with cavities for retaining isolated conductors, these conductors communicating with the back face opening for electrical and mechanical connection with insulated wire and communicating with the front face opening for electrical and mechanical connection with terminals from a terminal block. Among other applications, the patch connector may be used as a means to electrically connect multiple stranded or solid wires on terminals of a terminal block such as a 66-type terminal block used in the telephone industry.

31 Claims, 4 Drawing Sheets

PATCH CONNECTOR

BACKGROUND OF THE INVENTION

This invention relates to an electrical connector intended for use with terminal blocks commonly employed as a means of connection for wire networks. More specifically, this invention relates to an alternate means of making electrical connection between wire and terminal points without the aid of tools or soldering.

While the connection points on the terminal block may be capable of terminating wire directly; via a solder joint or insulation displacement, the patch connector provides a means for making additional connections for temporary or long term use. Once wired, the invention is a multiple wire connector that may be installed or removed from the terminal block without disturbing existing circuits for the purpose of branching off existing lines or connecting together discrete areas of the terminal field.

In the communications industry, and more particularly in the telephone industry, terminal blocks having a plurality of clip type electrical connectors or terminals protruding therefrom are commonly used. One such terminal block is the well known type 66 quick connect block. Having become widely accepted over the last twenty years, the 66-type quick connect blocks have evolved into many shapes and sizes and have been the focal point of a variety of accessories and adaptors. Examples of some common adaptors offered on the market are quick-connect clips that press onto the 66 terminals and may be terminated in the same manner as the base terminals. These adaptors have several limitations. For example, they cannot terminate stranded wire, they require the use of a special tool and cannot be easily relocated without risk or damage to the wire interface or of shorting the tip and ring conductors.

Test adapters that press onto the front of the terminal block are widely used to connectorize the terminals with modular jacks on other industry standard connectors. The limitation of these devices is that they cannot be field wired and they they cannot be mounted end to end or side to side without missing terminal locations that may require access. An example of such a test adaptor is described in U.S. Pat. No. 4,585,290, assigned to the assignee hereof and incorporated herein by reference. Other examples of prior art test adaptors are discussed in U.S. Pat. No. 4,585,290.

SUMMARY OF THE INVENTION

The above discussed and other problems and deficiencies of the prior art are overcome or alleviated by the patch connector of the present invention. In accordance with the present invention, the unassembled patch connector comprises a preferably one piece, molded housing having a centrally located hinge defining two oppositely disposed housing portions. The housing portions are folded about the hinge and snapped together to define a substantially rectangular housing having two, four, six or eight openings on a front face thereof for accessing terminals from a terminal block; and at least one other opening on the back face thereof for entry and exit of a cable or individual wires. The interior of the housing is provided with cavities for retaining bridge clips, the bridge clips communicating with the front face opening for electrical and mechanical connection with terminals from a block.

The present invention includes many features and advantages not present in prior art patching devices. For example, the present invention may be used as a termination tool to mount stranded or solid wire on terminals of a terminal block. The hinge aligns bridge clip contacts with wires that are placed into designated slots to terminate during closure without special tools or hardware. A latch mechanism is provided which secures the assembly and provides pressure for the molded-in wire srain relief areas so that no stresses on the cable or wire are transfered to the contact/wire interface. The patch connector will stack side to side and end to end on terminal blocks (i.e., 66 type terminal blocks or other terminal blocks with similar contact spacings). Another feature of the present invention is the incorporation of means for providing polarization to assure proper orientation of the patch by preventing it from seating fully when not properly installed.

The patch connector is designed in multiples of two such that the two conductors which constitute a line may be kept together, yet cannot be shorted. Still another feature of this invention is the ease of field assembly without special tools or operations, (e.g. soldering).

The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES:

FIG. 8 is a cross-sectional elevation view along the line 8—8 of FIG. 7.

DESCRIPTION OF THE PREFERRED EMBODIMENT

Figure 1:
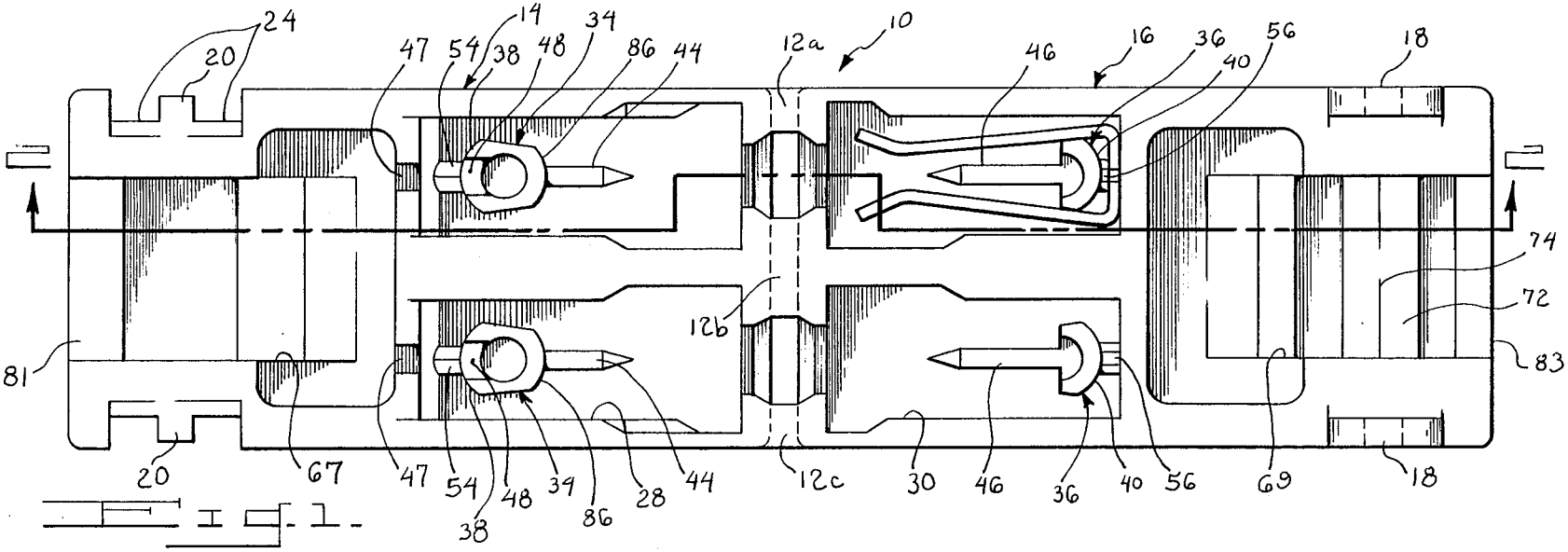
FIG. 1 is a plan view of an unassembled patch connector in accordance with the present invention.
Figure 2:
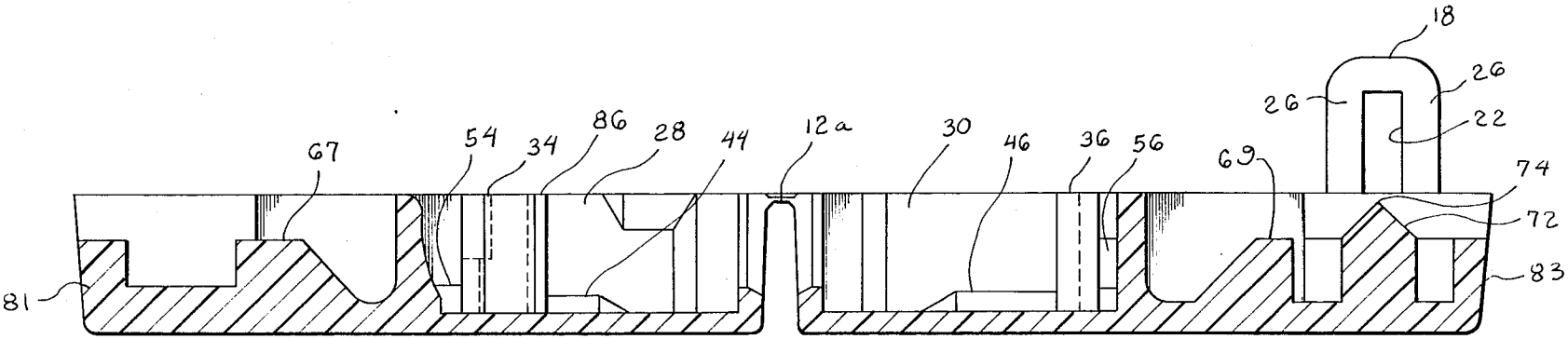
FIG. 2 is a cross-sectional elevation view along the line 2—2 of FIG. 1.
Figure 3:
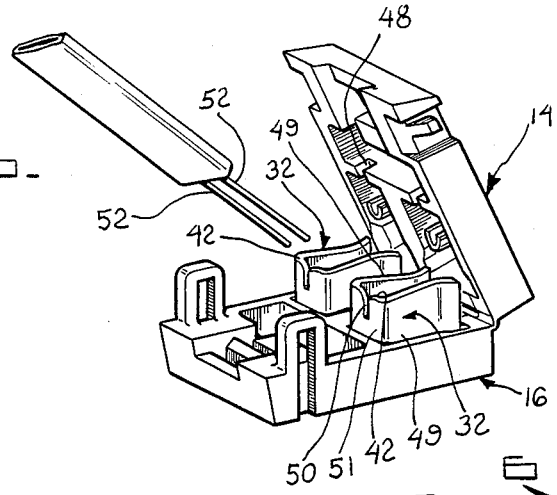
FIG. 3 is a perspective view of the patch connector patch of the present invention during assembly thereof.

Referring simultaneously to FIGS. 1–3, an unassembled housing of a single pair patch in accordance with the present invention is shown generally at 10. Housing 10 is typically comprised of a suitable insulative material such as a polymeric material (i.e., polyprolylene) and is preferably of a one-piece molded construction. Housing 10 includes centrally located hinge portions 12A, 12B and 12C. Hinges 12A–12C define two oppositely disposed first and second housing portions 14 and 16. As will be discussed hereinafter, housing 10 is foldable or bendable about hinges 12A–C such that housing portions 14 and 16 will mate and thereby define a substantially rectangular assembled housing (see FIGS. 3 and 4). Mated housing portions 14 and 16 are preferably held together by a snap action connecting means comprised of a pair of resilient extended slotted latches 18 and extensions 20. Thus, during closure, resilient latches 18 will contact extensions 20 whereupon latches 18 will be urged outwardly from housing 10 and wherein extensions 20 will be received by and retained in slots 22 of latches 18. It will be appreciated that extension 20 is provided with a pair of oppositely disposed channels 24 which are sized to receive the two parallel legs 26 of slotted latch 18.

Each of housing portions 14 and 16 are provided with cavities 28 and 30 for housing and retaining electrical connector clips such as the bridge clips shown at 32 in FIG. 3. Bridge clips 32 or other suitable electrical connectors are rigidly contained within cavities 28 and 30 by the surrounding side walls of the cavities as well as by a central support structure identified at 34 and 36 respectively. As shown in FIG. 1, each central support structure has an arcuate section 38 and 40 which preferably matches and corresponds to the interior arcuate section 42 of each bridge clip 32. Central support structures 34 and 36 also include longitudinal alignment ridges 44 and 46 which help to centralize and align a bridge clip 32 during insertion into cavity 28 or 30. Alignment ridges 44 and 46 also help to limit lateral movement of the patch unit 10 when mated with the terminal block.

Figure 4:
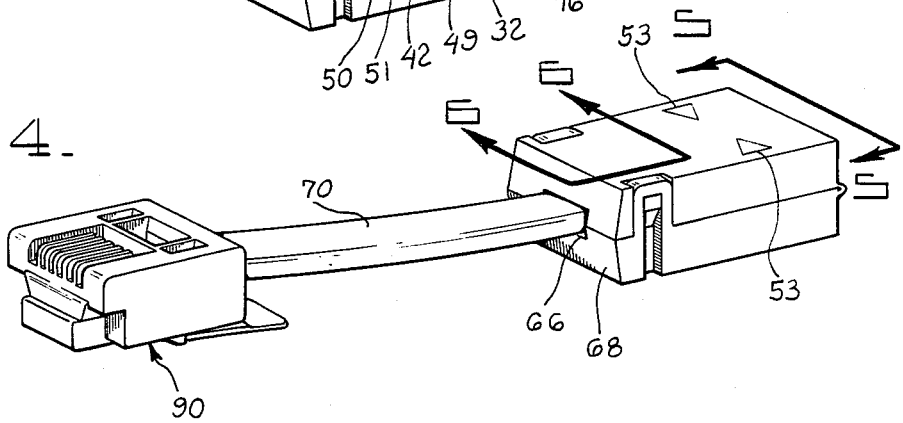
FIG. 4 is a perspective view of the patch connector adapter of the present invention subsequent to assembly thereof and being attached to a modular plug.

First housing portion 14 is preferably provided with a pair of aligned slots 47 and 48 for receiving and holding a wire prior to assembly of housing 10. During assembly, bridge clips 32 are preferably loaded into cavities 30 (rather than cavities 28). Also in a preferred embodiment, bridge clips 32 are of the "quick connect" type which permits relatively quick connections between wire means and the clips 32. Such "quick connect" type bridge clips have a well known construction including a pair of oppositely disposed arms 49 connected at a generally arcuate base 51 with arms 49 extending from the base 51. Arms 49 coverage to a point whereupon the arms diverge and terminate at an entrance section. The entrance section is adapted to receive a terminal from the terminal block and effect electrical and mechanical connection therewith. Bridge clips 32 further include stripping slots 50 (insulation displacement connector slots or IDC slots) centrally disposed therein (see FIG. 3). It will be appreciated that each bridge clip 32 includes a pair of oppositely disposed stripping slots 50 such as shown in FIG. 4 of U.S. Pat. No. 4,585,290. Thus, during assembly, bridge clips 32 are loaded into cavities 30 while individual wires or leads 52 are loaded into slots 47 and 48. Typically, the bridge clips are loaded into the patch connector during manufacturing so that the installer must only load leads 52 into slots 47 and 48. Next, second housing portion 16 is swung about hinges 12A–C whereby wire leads 52 will be engaged by stripping slots 50. As housing portion 16 engages with housing portion 14 and snaplocks thereto via the snaplock latch mechanism discussed above, wire leads 52 will be electrically and mechanically engaged with stripping slots 50 and thereby effect an electrical connection between wire leads 52 and bridge clips 32. It will be appreciated that corresponding cavities 28 and 30 will mate to define internal chambers for holding and retaining bridge clips 32.

Arrows 53 or other indicia are provided on the housing exterior to designate the area in which the installer should apply force to effect termination. While not necessary, a plier or other hand tool may be used to effect closure.

An important feature of the present invention is the presence of ribs 54 and 56 which are aligned with alignment ridges 44 and 46, respectively. Ribs 54 and 56 will engage the stripping slot on the bridge clip subsequent to loading and thereby center and hold the bridge clip in place during the assembly of housing 10. Since bridge clips 32 are preferably loaded into cavity 30, ribs 56 should have a relatively larger height as compared to ribs 54. It will be appreciated that the height of ribs 54 should be below the bottom of wire holding slots 48.

Figure 5:
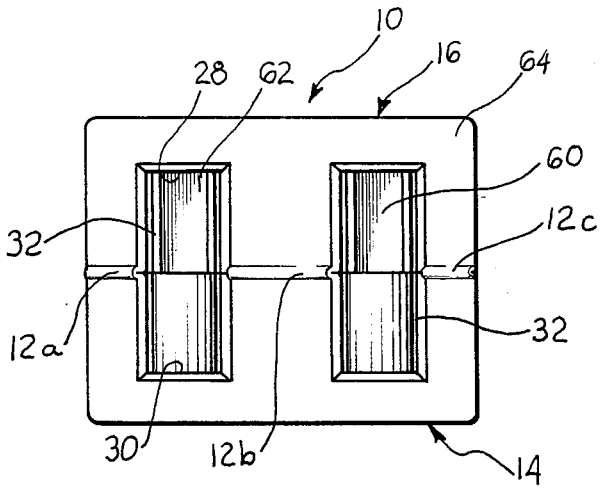
FIG. 5 is a front elevation view along the line 5—5 of FIG. 4.

Subsequent to connection between mating housing portions 14 and 16, a plurality of aperatures 60 and 62 will be formed on the front face 64 of rectangular housing 10 (ususally 2, 4, 6 or 8 openings) and a single rear opening 66 will be formed on the back face 68 of housing 10. Rear opening 66 will lead into an interior recess formed by recessed portions 67 and 69 of housing portions 14 and 16, respectively. It will be appreciated that slots 48 permit communication between opening 66 and the interior recess (formed by recessed portions 67, 69) on one side thereof; and cavities 28 and 30 on the other side thereof. As shown in FIG. 5, apertures 60 and 62 formed in front face 64 are substantially rectangular and are configured to accept and receive terminals (see FIGS. 9) from a terminal block which will mate with the bridge clips 32 disposed interiorly of housing 10. Rear aperture 66 is configured to permit exit and entry of a cable 70 which encases the individual wires 52 as shown in FIG. 3.

Figure 6:
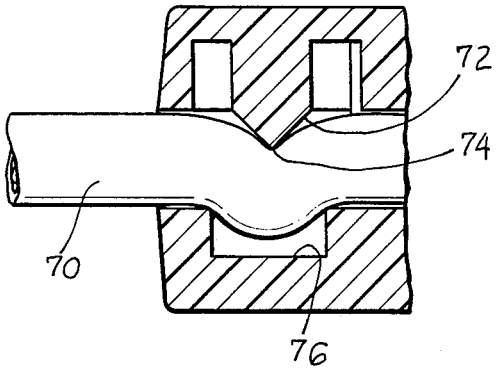
FIG. 6 is a cross-sectional elevation view along the line 6—6 of FIG. 4.

In a preferred embodiment of the present invention, housing 10 is provided with a strain relief mechanism to relieve the strain on cable 70 and preclude undesired disconnection between wires 52 and bridge clips 32. Referring to FIGS. 1 and 2, the cable strain relief comprises a ramped protrusion 72 which defines an edge 74, ramp 72 being located, for example, in second housing portion 16 in the area of latch mechanism 18; and a recess 76 which is also located in the snaplock area of the other housing portion, in this case, housing portion 14. During closure between the first and second housing portions 14 and 16, cable 70 will be positioned between edge 74 of ramp 72 in recess 76. As shown in FIG. 6, subsequent to closure between housing portions 14 and 16, cable 70 will have strain relief in that portion of cable 70 wherein the ramp extension 72 and particularly edge 74 contacts cable 70. As a result of the contact, cable 70 will bend to a certain extent and be received by cavity or recess 76.

The foregoing description relating to FIGS. 1–3 and 6 is concerned with a single pair patch for terminating jacketed station wire. In another embodiment of the present invention shown at FIGS. 7 and 8, a single pair patch is presented which is specifically configured for use with nonjacketed solid or stranded wire (typically 22–24 AWG). This second embodiment includes a strain relief mechanism for twisted part cross-connect wire. For the most part, the alternative embodiment of a single pair patch identified at 10′ in FIGS. 7 and 8 is identical to the FIG. 1 embodiment and therefore identical structural elements are identified in the same manner with the addition of a prime.

Figure 7:
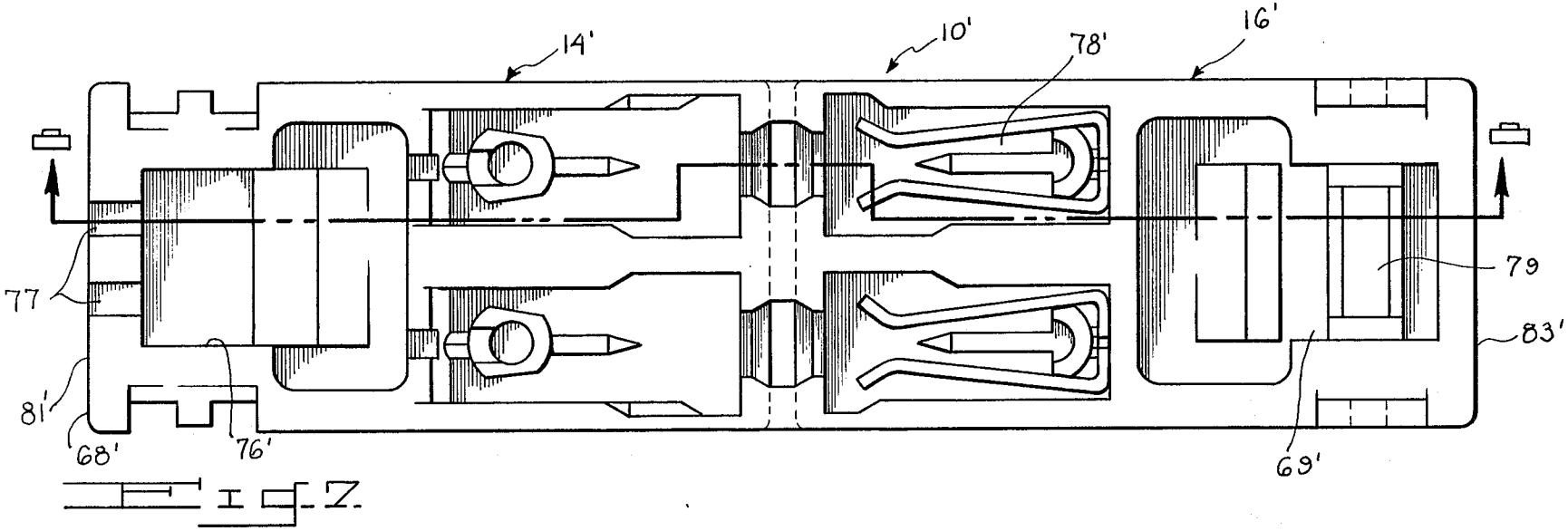
FIG. 7 is a plan view similar to FIG. 1, of another embodiment of the single pair patch of the present invention prior to assembly.
Figure 1:
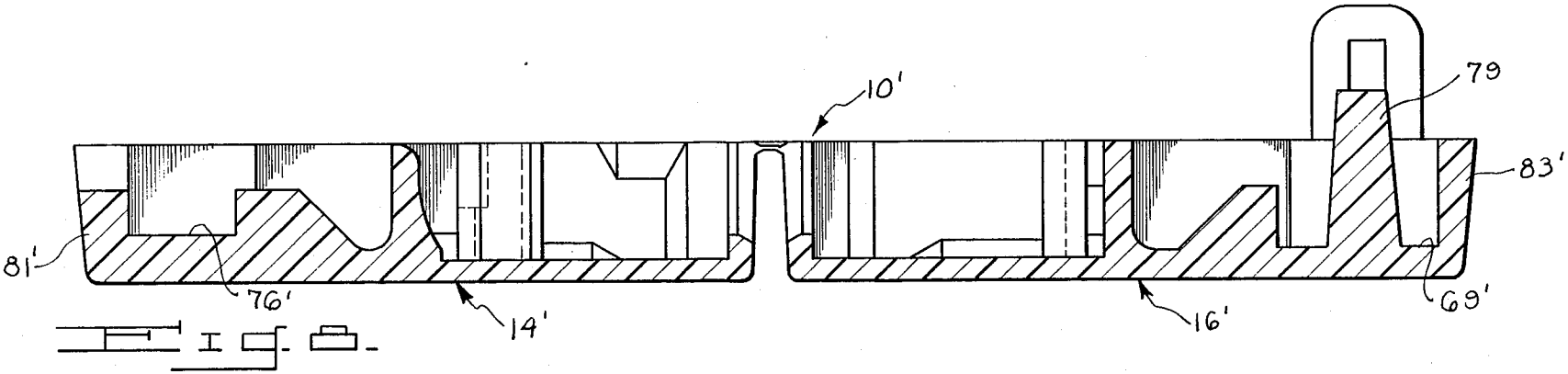

In FIGS. 7 and 8, a pair of rear openings in the form of grooves 77 are provided for entry of individual wire leads (rather than a single jacketed cable as in FIGS. 1 and 2) from rear face 68′ to recess 76′. Strain relief means are also provided to the FIGS. 7 and 8 embodiment which are especially configured for use with individual solid or stranded wire leads. The strain relief means comprises a protrusion 79 extending from a recess 69' of a housing portion 14' or 16' (recess 69' of housing portion 16' in the example not shown). Protrusion 79 has a flat top and extends upwardly and outwardly of housing portion 16'. Protrusion 79 is adapted to be received by recess 76' of housing portion 14'. As with the strain relief means of FIG. 6, blunt-edged protrusion 79 will contact the individual wire leads causing the individual wires to bend to a certain extent and be received by recess 76'. The only other significant differences between the single pair patch of FIGS. 7 and 8, and that of FIGS. 1 and 2 is that the end walls 81' and 83' (which together form rear face 68') have a larger height relative to end walls 81' and 83' of housing 10. This is due to the absence of a single large rear opening 66 (and replacement with a pair of grooves 77) in the FIG. 7 embodiment of the present invention.

Figure 9:
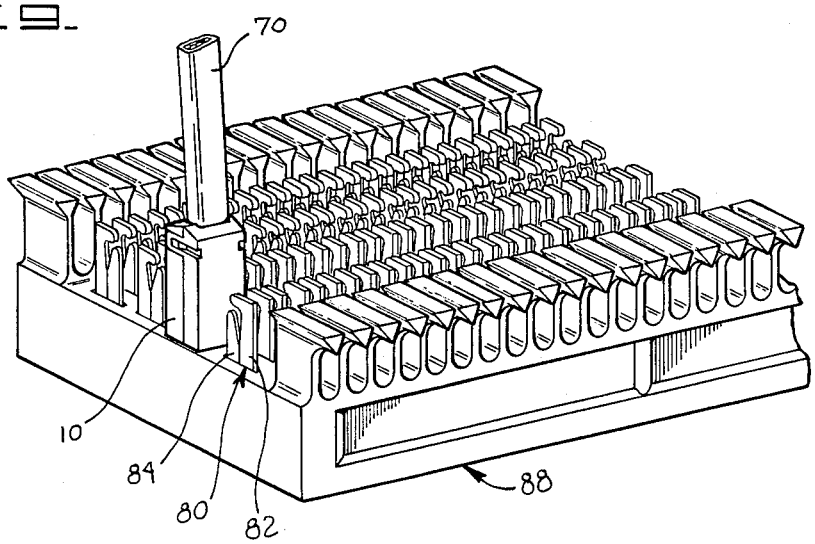
FIG. 9 is a perspective view of the present invention subsequent to connection with terminals from a terminal block.

Another important feature of the present invention is the incorporation of means for polarizing or pseudo-polarizing the single pair patch on the terminals. This polarization means prevents the patching device from fully seating on the terminals extending from the terminal block (or conversely, it permits the patching device to fully seat on the terminals when correctly oriented). Referring to FIG. 9, a 66-type quick connect terminal 80 comprises two members 82 and 84 of which member 82 has a larger height than member 84. Thus, when a single pair patch 10 is inserted onto terminals 80 via openings 60, 62 member 82 will extend outwardly of member 84 and therefore be closer to rear face 68. Referring again to FIGS. 1 and 7, second housing portion 16 includes a pair of central supports 36. Comparing supports 36 of housing portion 16 to supports 34 of housing portion 14, it is evident that each support 34 includes a lower acuate portion 86 which is not present in supports 36. As a consequence, subsequent to assembly, lower arcuate portions 86 on supports 34 will act as a block to preclude terminal members 82 from passing therethrough. Conversely, supports 36 (without lower acuate portions 86) will permit terminal members 82 to pass therethrough. The result is a pseudo-polarized patching device which permits firm seating on a pair of 66-type terminal in one direction or orientation only. Thus, in FIG. 9, a single pair patch 10 in accordance with the present invention is shown subsequent to being terminated to two pair jacketed cable 70 and being connected onto a pair of 66-type terminals 80 extending from a well known 66M or B terminal block 88.

As discussed individual wire leads or jacketed cable may be electrically and mechanically connected to patching 10. These leads or cable may then terminate onto another block, test equipment, or any other suitable location including a modular jack or plug such as the well known modular plug 90 shown in FIG. 4.

The patching device of the present invention has many important features and advantages including the following:

(1) Adds flexibility to existing 66-type block installations;
(2) Low cost alternative to other patch systems;
(3) Allows mutliple terminations on a single 66-type terminal clip;
(4) Permits quick assembly and installations;
(5) Permits side by side and end stacking on terminal blocks (i.e, 66M and B blocks);
(6) Terminates 22–24 guage solid and stranded wire whereas the standard 66 type terminal clips will only terminate solid wire;
(7) Permits easy and therefore inexpensive circuit rearrangements;
(8) Provides cost effective modular patching for data application; and
(9) In addition, the relatively simple construction leads to low manufacturing costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A patch connector for terminating at least a pair of wires and for accessing at least a pair of terminals extending outwardly from a terminal block comprising:

housing means having a first mateable housing portion hingedly connected at a first end by hinge means to a first end of a second mateable housing portion and including means for attaching said first and second mateable housing portions, said housing means defining a front face and a rear face, said front face being formed by the mating of said first end of said first mateable housing portion to said first end of said second mateable housing portion;

at least a pair of cavities in each of said first and second housing portions, said pairs of cavities in said first housing portion communicating with respective pairs of cavities in said second housing portion to define at least a pair of electrical connector clip chambers;

a discrete electrical connector clip in each of said electrical connector clip chambers, each connector clip being adapted to terminate wire wherein said hinge means connecting said first and second mateable housing portions is transverse to the wire to be terminated;

support means for supporting and aligning said connector clips in said chambers;

said front face of said housing means having at least a pair of apertures, each of said apertures communicating with said chambers, each of said apertures being large enough to receive a terminal extending from a terminal block and permit electrical contact between the terminal and a respective connector clip; and said rear face having at least one opening therethrough, said opening communicating with said chambers.

2. The patch connector of claim 1 wherein:

said means for attaching said first and second mateable housing portions comprise snap action connecting means.

3. The patch connector of claim 2 wherein said snap action connecting means includes:

a pair of resilient slotted latch means attached to one of said first or second housing portions and extending outwardly thereof; and a pair of extensions on the other of said first or second housing portions wherein when said resilient latch means contacts said extensions, said latch means will be urged outwardly from said housing means and wherein said extensions will be received by and retained in the slots of said latch means.

4. The patch connector of claim 3 including:

a pair of channels oppositely disposed on opposed sides of said extensions, said channels being sized to received said latch means.

5. The patch connector of claim 1 wherein:

said housing means has a substantially rectangular configuration.

6. The patch connector of claim 1 wherein each electrical connector clip comprises:

a pair of oppositely disposed arms connected at a base and extending therefrom, said extended arms converging to a point whereupon said arms diverge and terminate at an entrance section, said entrance section being adapted to receive a terminal from the terminal block and effect electrical and mechanical connection therewith.

7. The patch connector of claim 6 wherein said base of each connector clip includes at least one stripping slot.

8. The patch connector of claim 6 wherein said support means for supporting and aligning said clips comprise:

at least a pair of support members in said pairs of cavities, said support members extending upwardly therefrom, said support members having an outer configuration corresponding to the configuration of the space defined between said base and said arms of said connector clips.

9. The patch connector of claim 8 wherein said space defined between said base and arms of said connector clips is arcuate; and wherein said support members have an arcuate configuration.

10. The patch connector of claim 8 including:

longitudinal alignment ridges in said cavities and extending from each of said support members toward said front face of said housing means.

11. The patch connector of claim 8 wherein said base of each connector clip includes a pair of oppositely disposed stripping slots and further including:

rib means in said cavities extending from said support members toward said rear face of said housing means, said rib means adapted for engagement with said stripping slots.

12. The patch connector of claim 10 wherein said base of each connector clip includes a pair of oppositely disposed stripping slots and further including:

rib means in said cavities extending from said support members toward said rear face of said housing means, said rib means adapted for engagement with said stripping slots.

13. The patch connector of claim 12 wherein:

said rib means are in alignment with said alignment ridges.

14. The patch connector of claim 1 including:

a recess portion in each of said housing portions, said recess portions being positioned between said cavities and said opening in said rear face of said housing means, said recess portions in said housing portions cooperating to define an interior recess.

15. The patch connector of claim 14 including:

at least a pair of slots in at least one of said housing portions for connecting said interior recess to said connector clip chambers.

16. The patch connector of claim 14 including:

strain relief means in said recess portions.

17. The patch connector of claim 16 wherein said strain relief means comprises:

a protrusion extending from one of said recess portions.

18. The patch connector of claim 17 wherein:

said protrusion has a ramp configuration.

19. The patch connector of claim 17 wherein:

said protrusion has a flattened top.

20. The patch connector of claim 1 wherein:

said rear face has at least two openings therethrough, said two openings being adapted for receiving electrical wiring.

21. The patch connector of claim 8 wherein:

one of said pair of support members includes an extension member whereby said extension member acts as a block to selected terminals from a terminal block and thereby effects polarization.

22. The patch connector of claim 1 including:

electrical wires having a first end and a second end being positioned at said first end through said opening in said rear face and being electrically connected to said connector clips.

23. The patch connector of claim 22 wherein:

said electrical wires are jacketed.

24. The patch connector of claim 22 including:

modular plug means electrically connected to said second end of said electrical wires.

25. The patch connector of claim 22 wherein said rear face includes a plurality of openings and wherein:

said electrical wires are positioned through each of said openings.

26. The patch connector of claim 1 wherein:

said housing means has a one piece construction.

27. The patch connector of claim 26 wherein:

said housing means is molded.

28. A patch connector comprising:

housing means having a first mateable housing portion hingedly connected to a second mateable housing portion and including means for attaching said first and second mateable housing portions, said housing means defining a front face and a rear face;

at least a pair of cavities in each of said first and second housing portions, said pairs of cavities in said first housing portion communicating with respective pairs of cavities in said second housing portion to define at least a pair of electrical connector clip chambers;

an electrical connector clip in each of said electrical connector clip chambers;

support means for supporting and aligning said connector clips in said chambers;

said front face of said housing means having at least a pair of apertures, each of said apertures communicating with said chambers, said rear face having at least one opening therethrough, said opening communicating with said chambers;

wherein each electrical connector clip comprises a pair of oppositely disposed arms connected at a base and extending therefrom, said extended arms converging to a point whereupon said arms diverge and terminate at an entrance section, said entrance section being adapted to receive a terminal from a terminal block and effect electrical and mechanical connection therewith;

wherein said support means for supporting and aligning said clips comprises at least a pair of support members in said pairs of cavities, said support members extending upwardly therefrom, said support members having an outer configuration corresponding to the configuration of the space defined between said base and said arms of said connector clips; and longitudinal alignment ridges in said cavities and extending from each of said support members toward said front face of said housing means.

29. The patch connector of claim 28 wherein said base of each connector clip includes a pair of oppositely disposed stripping slots and further including:

rib means in said cavities extending from said support members toward said rear face of said housing means, said rib means adapted for engagement with said stripping slots.

30. The patch connector of claim 29 wherein:

said rib means are in alignment with said alignment ridges.

31. A patch connector comprising:

housing means having a first mateable housing portion hingedly connected to a second mateable housing portion and including means for attaching said first and second mateable housing portions said housing means defining a front face and a rear face;

at least a pair of cavities in each of said first and second housing portions, said pairs of cavities in said first housing portion communicating with respective pairs of cavities in said second housing portion to define at least a pair of electrical connector clip chambers;

an electrical connector clip in each of said electrical connector clip chambers;

support means for supporting and aligning said connector clips in said chambers;

said front face of said housing means having at least a pair of apertures, each of said apertures communicating with said chambers, said rear face having at least one opening therethrough, said opening communicating with said chambers;

wherein said electrical connector clip comprises a pair of oppositely disposed arms connected at a base and extending therefrom, said extended arms converging to a point whereupon said arms diverge and terminate at an entrance section, said entrance section being adapted to receive a terminal from a terminal block and effect electrical and mechanical connection therewith;

wherein said support means for supporting and aligning said clips comprises at least a pair of support members in said pairs of cavities, said support members extending upwardly therefrom, said support members having an outer configuration corresponding to the configuration of the space defined between said base and said arms of said connector clips;

wherein said base of each connector clip includes a pair of oppositely disposed stripping slots; and rib means in said cavities extending from said support members toward said rear race of said housing means, said rib means adapted for engagement with said stripping slots.

* * * * *